US005339914A

United States Patent [19]

Lee

[11] Patent Number: 5,339,914

[45] Date of Patent: Aug. 23, 1994

[54] ADJUSTABLE DRILLING MECHANISM

[75] Inventor: Paul Lee, Calgary, Canada

[73] Assignees: PBL Drilling Tools Ltd.; PBL Machinery Ltd.; Bernard J. Lee, Calgary, Canada

[21] Appl. No.: 3,560

[22] Filed: Jan. 13, 1993

[30] Foreign Application Priority Data

Jan. 23, 1992 [CA] Canada ..... 2059910

[51] Int. Cl.[5] ..... E21B 7/08

[52] U.S. Cl. ..... 175/73; 175/325.4

[58] Field of Search ..... 175/325.4, 325.2, 73

[56] References Cited

U.S. PATENT DOCUMENTS

| | | | |
|---|---|---|---|
| 3,371,729 | 3/1968 | Carr | 175/321 |
| 3,572,450 | 3/1971 | Thompson | 175/325.4 |
| 4,270,619 | 6/1981 | Base | 175/325.4 |
| 4,428,626 | 1/1984 | Blau et al. | 175/325.4 |
| 4,491,187 | 1/1985 | Russell | 175/325 |
| 4,557,339 | 12/1985 | Falknor | 175/325 |
| 4,572,305 | 2/1986 | Swietlik | 175/325.4 |
| 4,754,821 | 7/1988 | Swietlik | 175/325.4 |
| 4,821,817 | 4/1989 | Cendre et al. | 175/325.4 X |
| 4,848,490 | 7/1989 | Anderson | 175/325.4 |
| 4,854,403 | 8/1989 | Ostertag et al. | 175/325.4 |
| 5,131,479 | 7/1992 | Boulet et al. | 175/73 |
| 5,181,576 | 1/1993 | Askew et al. | 175/73 X |

FOREIGN PATENT DOCUMENTS

| | | |
|---|---|---|
| 0409446 | 1/1991 | European Pat. Off. . |
| 0427437 | 5/1991 | European Pat. Off. . |
| 2026063 | 1/1980 | United Kingdom . |
| 2223251 | 4/1990 | United Kingdom . |
| 2251444 | 7/1992 | United Kingdom . |

*Primary Examiner*—Hoang C. Dang

*Attorney, Agent, or Firm*—Zarley, McKee, Thomte, Voorhees & Sease

[57] ABSTRACT

A down hole drilling tool activating mechanism is provided which will adjustably activate tool elements such as stabilizer pads by a mandrel which will move vertically against a bias spring and has inclined surfaces to bear on the inside of the adjustable pads creating variable diameters. The mandrel has a series of flexible fingers which engage the main body of the tool. A male spline element is provided which moves vertically within the body of the tool so that a portion thereof moves between a position in which it engages the fingers and forces them into engagement thereby locking the mandrel against vertical movement and a second unlocked position in which the portion is removed from the fingers allowing them to flex and allowing them to disengage the body so that the mandrel may move vertically changing the adjustment of the tool. An improved version may be provided with a port to equalize pump pressure between the inner bore and outer surface of the male spline element to prevent unwanted relative movement due to increased pump pressure.

8 Claims, 9 Drawing Sheets

ADJUSTABLE DRILLING MECHANISM

TECHNICAL FIELD

This invention relates to improvements in oil well drilling equipment. In particular, it relates to an improved mechanism for activating down hole adjustable stabilizers.

Furthermore, the present invention provides an adjustable stabilizer which has a number of selectable positions which can be locked in place or released.

BACKGROUND OF THE INVENTION

In recent years drilling techniques for oil and gas wells have developed to the point where sophisticated controls may be used to alter the direction or rate of advance of the drilling bit. Among these techniques is the use of a device widely known as an adjustable stabilizer whereby a section of drill pipe (often referred to as a sub) near the bottom of the drill string slightly behind the bit, may be used to alter the manner in which the drill string rests against the side of the hole and thereby change the direction of the nearby bit, and hence the direction of the hole. These adjustable stabilizers frequently take the form of pads mounted in the sub which can be expanded radially to increase the diameter of the sub or released and contracted to narrow the effective diameter of the drill string at the location of the stabilizer sub.

In addition, the marginal profitability of many oil and gas well drilling operations requires that these control functions be capable of operating with a minimum of down time. It is, therefore, important to develop activating mechanisms which can be controlled by the driller without withdrawing the drill string and stabilizer sub from the hole which is a time consuming interruption in the drilling performance. Consequently, various techniques have been developed for manipulating the mechanism of adjustable stabilizers while the equipment is down hole.

Some of these prior mechanisms have been controlled by adjusting the weight on the drill string but this approach has the disadvantage that often it is very hard to determine the actual weight which is being applied at the down hole location of the stabilizer sub because deep, deviated holes have a large amount of "hole drag".

Other mechanisms are designed to be set or released by the flow rate at which drilling mud is pumped through the central bore of the drill string. However, often the rig is operating at close to the maximum flow rate and therefore there is little flexibility available to increase the flow enough to activate a tool of this design.

Still other mechanisms rely on controls activated by the pressure of the drilling mud but like the former flow set tools, a range of pressures is not always available to the driller, or it may not be desirable to operate the drill at less than maximum pressure. For the above reasons, it is important to develop mechanisms by which down hole devices such as stabilizers may be engaged or disengaged by operations which can be conducted at the drill floor but without limiting the drillers ability to select the desirable weight, flow rate or mud pump pressure for optimum conditions during drilling operations.

DISCLOSURE OF THE INVENTION

It is, therefore, the purpose of this invention to provide a down hole control mechanism for adjustable stabilizers and other tools which may be activated from the drill floor without pulling out the drill string.

It is a further purpose of this invention to provide a control mechanism for down hole tools which may be set and locked so that it will remain at the desired setting regardless of variations in the drill string weight, mud flow rate, or pump pressure which a driller wishes to use during the drilling operations.

It is a further purpose of this invention to provide a mechanism which may be activated, locked and subsequently unlocked and readjusted repeatedly as required.

It is a further purpose of this invention to provide a control mechanism which may be activated by varying degrees to provide the desired setting of the tool as required with some degree of certainty and precision.

These objects and other advantages are sought to be achieved by the present invention which provide a down hole drilling tool activating mechanism comprising a drill sub connectable between adjacent lengths of drill pipe having a main body and tool elements mounted in the body to be activated and deactivated by a mandrel located within the body, capable of vertical movement relative to the main body and having cam surfaces bearing against the tool elements to activate and deactivate same upon vertical movement of the mandrel. A series of flexible fingers extending from one end of the mandrel and vertically fixed thereto has engaging teeth thereon and teeth engaging means mounted to said body and vertically fixed thereto so that the mandrel and the main body are fixed vertically relative to each other when the teeth and teeth engaging means are engaged. A male spline member is rotatably locked to said main body to permit rotational forces to be transmitted through the tool but the male spline member is capable of vertical movement relative to the main body, by lifting or lowering the drill string, and a portion of the male spline member is moveable vertically within the main body between a locking position in which the male portion engages the flexible fingers forcing them to engage with the tooth engaging member and an unlocked position in which the portion of the male spline member is removed from the flexible fingers to allow them to disengage said teeth engaging member. Bias means, such as a spring, is located to urge the mandrel in one vertical direction and seal means are provided on said mandrel located such that mud pump pressure exerted through the bore of the drill string will act on the end of the mandrel in a direction opposite to the bias means.

In one embodiment, the activating mechanism is used in connection with a tool which is a stabilizer and the tool elements are radially adjustable pads capable of adjusting the diameter of the stabilizer tool.

In one variation of the invention, the mechanism is designed so that the pads have inwardly inclined surfaces and the mandrel has truncated conical shaped elements bearing against the inclined surfaces of the pads.

In another variation of the invention, the mandrel comprises at least one surface adapted to bear against the inner surface of the pads in which said mandrel surface is shaped to provide an increasing radial dimension in a given circumferential direction so that rotational movement will activate or deactivate the pads.

The tool may be designed so that the pads are arranged in a helical configuration and the mandrel has a similar helical configuration about the longitudinal axis of the tool. In variations where a rotational motion is required or a helical mandrel is employed, the rotational movement of the mandrel is controlled by a key and keyway controlling the relative rotational movement between the mandrel and the main body.

The invention may also be provided with a flow restrictor mounted on the drill sub comprising a restrictor sleeve mounted for movement with the movement of the mandrel and a bullet mounted for movement with the main body such that when the mandrel is moved relative to the main body, back pressure resulting from the restricted flow is variable according to the relative vertical position of the mandrel compared to the main body and the position may be determined by the operator.

An improved version of the tool may be provided in which the tendency of the tool to extend due to pump pressure can be balanced by a port which allows the pump pressure to be exerted on the exterior of the male spline against a fixed seal ring fastened to the exterior surface of the male spline while resisted in the upward direction by a fixed seal ring mounted between the male spline and the main body.

BRIEF DESCRIPTION OF THE DRAWINGS

The present invention may be better understood by a description of one embodiment thereof with reference to the attached drawings in which.

BEST MODE OF CARRYING OUT THE INVENTION

Figure 1:
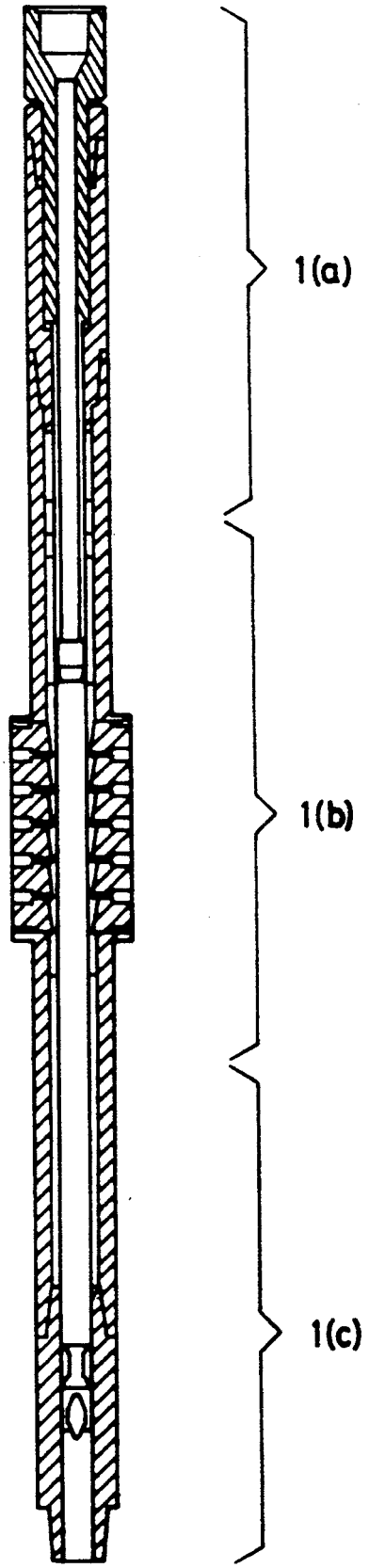
FIG. 1 is a vertical cross section of an embodiment of the present invention separated in sections 1(*a*), 1(*b*) and 1(*c*) shown in enlarged drawings 1A, 1B and 1C.
Figure 1A:
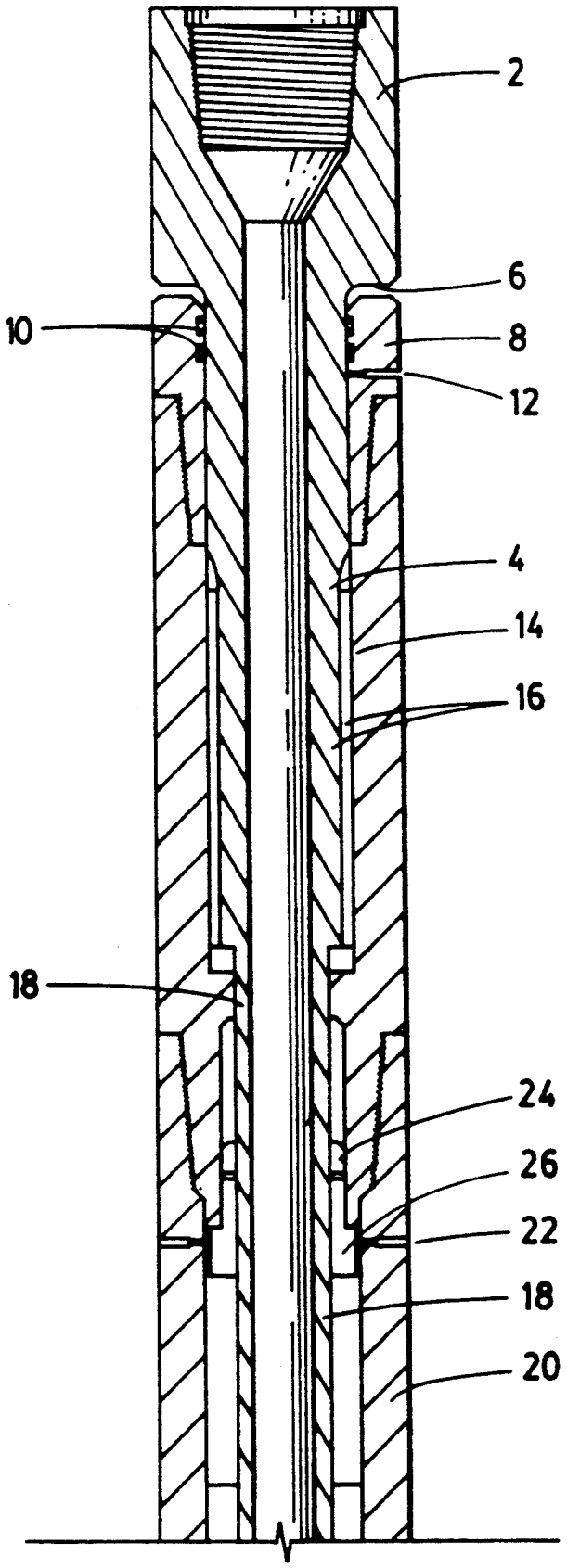
Figure 1B:
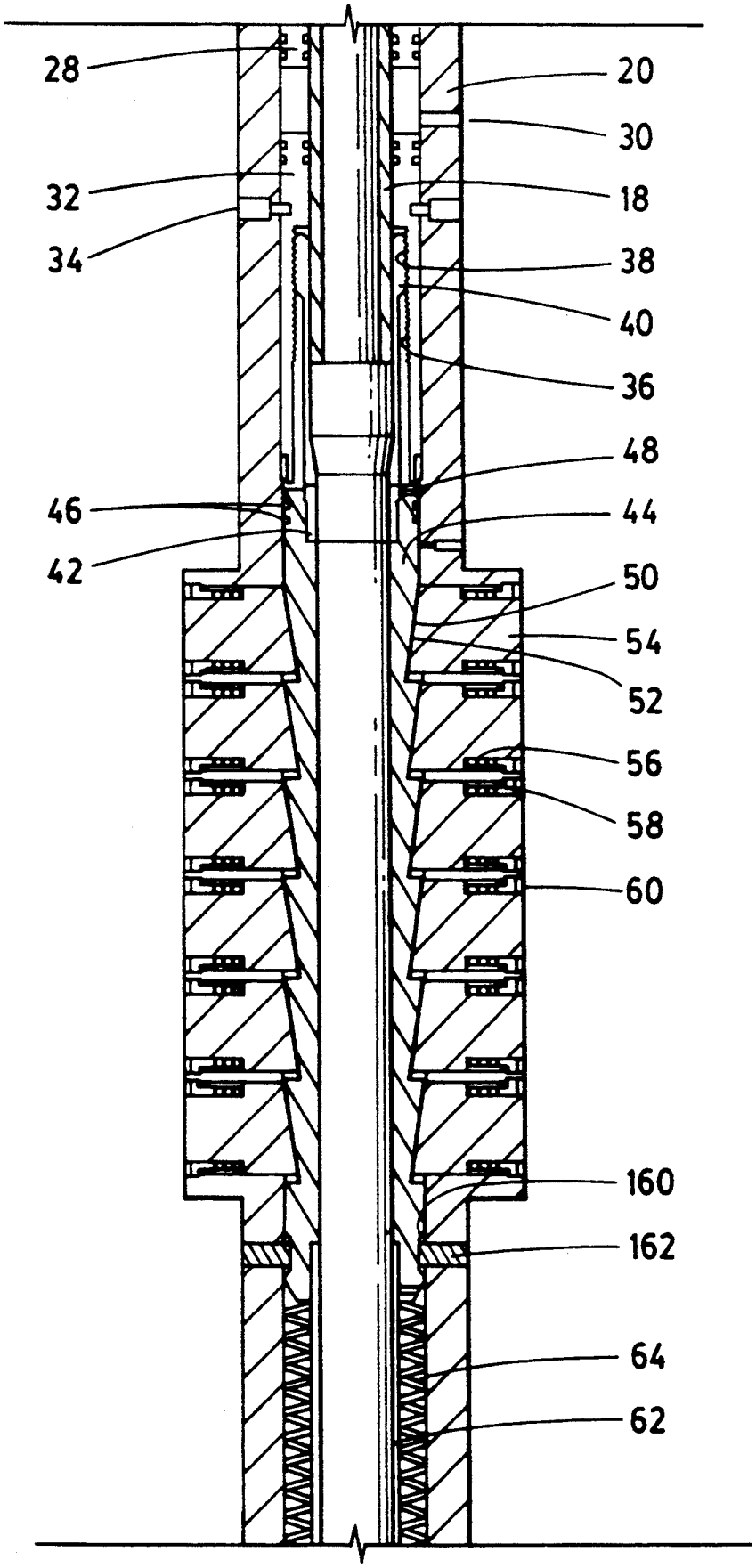
Figure 1C:
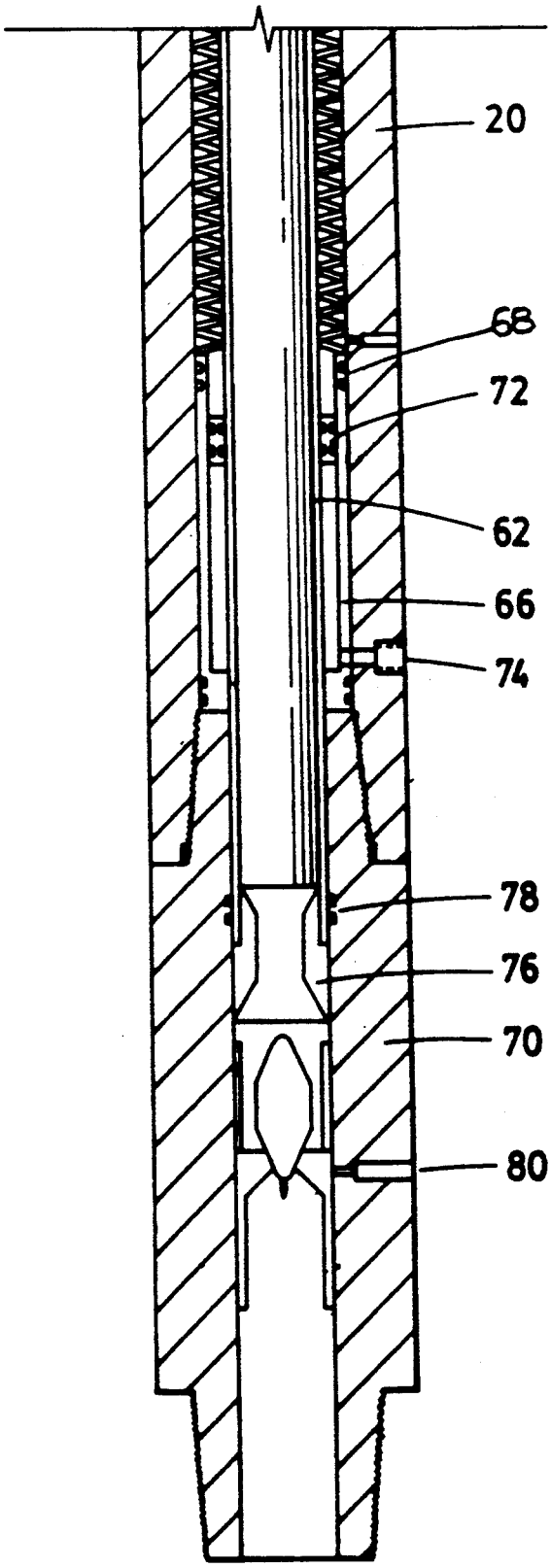

Although the present invention may have other applications, the preferred embodiment illustrated in the drawings applies to a multi-position adjustable stabilizer sub shown in FIG. 1. The elements shown in FIG. 1(*a*) include a box end 2 of a stabilizer sub attached to a male spline 4 which has a male spline shoulder 6 immediately above a seal cap 8 having seals 10 isolating the bottom of the male spline 4 and an oil plug 12. The seal cap 8 is threadedly engaged to a female spline section 14 so that a longitudinal section of spline bars 16 have overlapping adjacent splines from the male and female section respectively so that the male spline 4 may move vertically with respect to the female spline but the two are locked circumferentially so that rotational movement may be transmitted through them from the drill string above to the drill string below.

Threaded onto the bottom of the female spline is the main body 20 of the stabilizer sub into which extends the lower extension 18 of the male spline 4.

The main body is provided with an oil plug 22. Between the lower extension of the male spline 18 and the lower bore of the female spline is an upper stopper ring 24 threaded to the male spline extension and a lower stopper ring 26 threaded to the bore of the female spline 14.

As best seen in FIG. 1(*b*), a floating piston 28 is positioned between the male spline extension 18 and the inner bore of the main body 20. Below the floating piston 28 is an annular port 30 equalizing the fluid pressure of the annular space between the drill string and the bore hole with the inner space between the male spline extension and the main body.

Beneath the annular port is a slip seal ring 32 sealed against the extension 18 and the main body and fixed in position by set screws 34 locking it relative to the main body 20. The bored out section of the slip ring 32 has a set of inwardly facing teeth 36 which engage a set of outwardly facing teeth 38 on a series of slip fingers 40 spaced at intervals around the periphery of the male spline extension 18.

The fingers 40 are connected at their lower end to a ring 42 threaded into the top of a pad mandrel 44 so that the fingers and pad mandrel are fixed vertically together.

A set screw 48 holds the ring 42 in position and a set of seals 46 isolate the slip fingers and slip seal ring from the drilling mud and annulus pressure to which the lower end of the pad mandrel is exposed.

The pad mandrel 44 has a series of inclined or tapered surfaces 50 which engage similarly inclined surfaces 52 of the pads 54. Thus, when the mandrel is moved vertically downward, the inclined surfaces will force the pad 54 outward in a radial direction providing an increased diameter to the drill string at that location. The details of this activation will be referred to below.

The pads 54 are biased in the inward direction by pad springs 56 and are isolated from the anular mud by pad seals 58 held in place by pad lock rings 60.

For purposes of the illustration in FIG. 1, the pads are shown vertically aligned in the plane of the cross section. It is, however, possible and even advantageous to arrange these pads in a sequence along an inclined helical path or pattern so that the contact with the bore hole will be provided for in a uniform distribution about the periphery of the stabilizer sub.

The bottom of the pad mandrel, like the top, has a cylindrical portion which fits within the lower end of the main body 20 below the adjustable stabilizer pads.

The bottom of the pad mandrel has a wash pipe 62 connected by threads having an internal diameter equivalent to the ID of the male spline and the pad mandrel but having an outer diameter substantially reduced so as to leave a chamber between it and the lower main body 20 housing a spring 64 which urges the mandrel upward.

As seen in FIG. 1(*c*) the spring 64 rests at its lower end on a seal sleeve 66 mounted in the lower end of the main body 20 and held in place by the pin end of a bottom sub 70.

The seal sleeve 66 is provided with outer seals 68 against the main body 20 and a lower floating piston 72 between the sleeve and the wash pipe 62. A lower anular port 74 allows equalization of the pressure between the bore hole annulus and the interior of the seal sleeve.

The bottom sub 70 has a restrictor sleeve 76 threadedly connected to the lower end of the wash pipe 62 and the wash pipe at its lower end is sealed against the body of the bottom sub by bottom sub seals 78.

Beneath the restrictor sleeve, a restrictor bullet is inserted in the bore of the bottom sub in such a way that it combines with the restrictor sleeve to effect the flow rate and back pressure when mud is pumped through the bore. Because the bullet is fixed in the bottom sub 70 by a set screw 80 the flow restriction will depend on the relative position of the restrictor sleeve which in turn is determined by the vertical placement of the pad mandrel to which it is connected by means of the wash pipe 62.

The lower end of the bottom sub is provided with a threaded pin end for connection to the lower end of the drill string carrying the drill bit.

Figure 6:
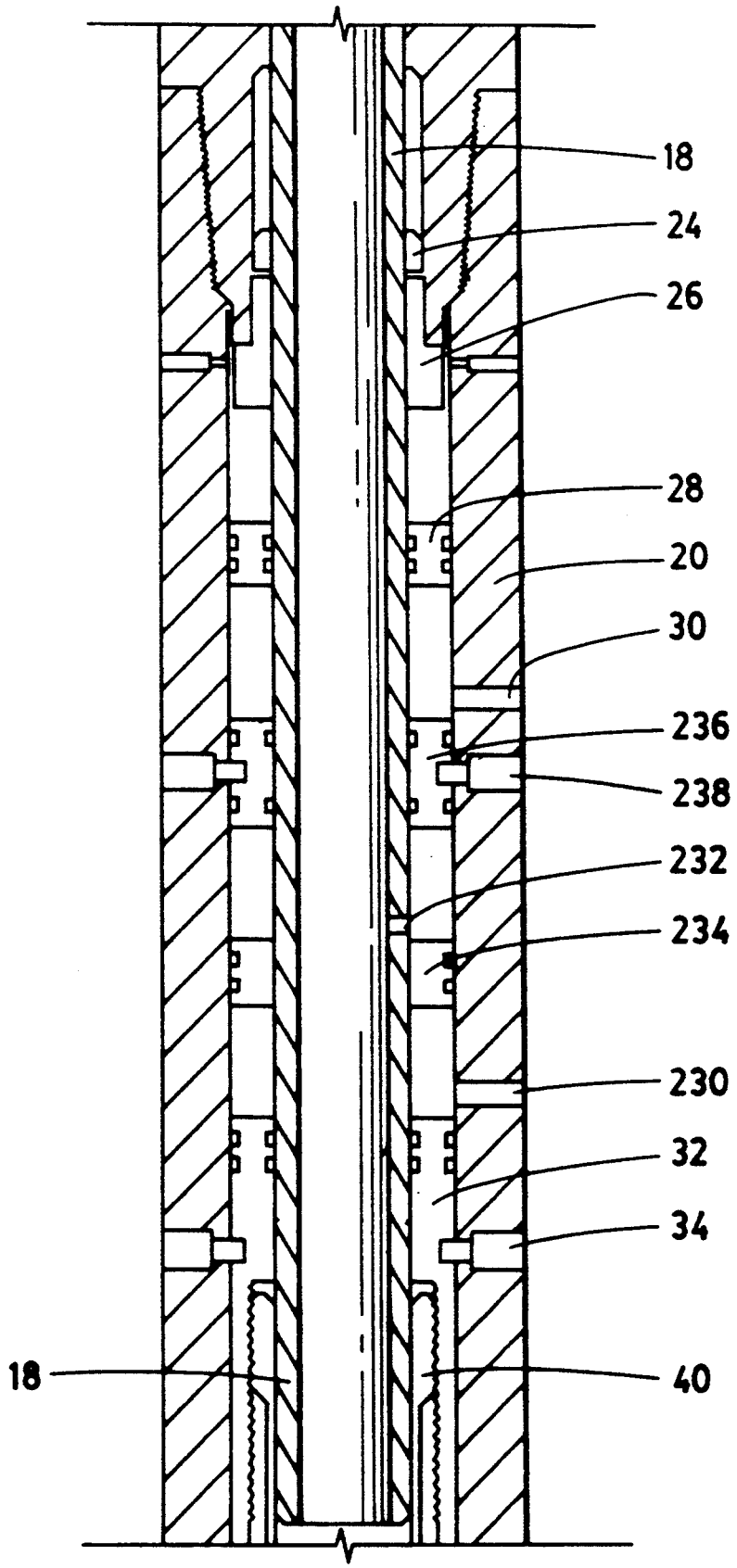
FIG. 6 is an improved version of the assembly illustrated in FIG. 1.

In FIG. 6, an improved version of the adjustable mechanism is illustrated. Numerous features remain the same, namely; the male spline extension 18, the upper stopper ring 24, the lower stopper ring 26, the floating piston 28, annular port 30, slip seal ring 32, set screws 34, slip fingers 40.

However, the embodiment illustrated in FIG. 6 contains additional features which serve to prevent the effect of increased pump pressure tending to drive the male spline and extension vertically upwards against the weight of the drill string. To overcome this tendency, an additional annular port 230 is provided below the annular port 30. In between, an extension port 232 communicating between the inside and the exterior side of the extension 18 is provided so that pressure between the bore of the extension and the space between the extension and the main body 20 will be equalized.

To prevent that equalized pressure from acting upwards on the male spline, a fixed seal 236 closes the gap between the extension and the main body above the extension port 232 and is held in place by set screws 238. Beneath the extension port 232, an extension seal 234 is provided which is threadedly or otherwise fastened to the exterior surface of the extension while providing a moveable seal against the inner surface of the main body 20. In this way, the pump pressure applied to the bore of the extension will be communicated to the gap through the port 232 and will be exerted downwardly on the seal ring 234 so as to downwardly balance the upward pressure felt by the male spline due to pump pressure acting on the bottom of the extension 18 and other surfaces of the male spline which are exposed to pump pressure.

INDUSTRIAL APPLICATION

By the mechanism illustrated in FIG. 1, the effective diameter of the stabilizer sub may be altered from the minimum diameter shown in the illustration to a larger diameter represented by the full outward radial extension of the pads 54. Furthermore, by virtue of the combination of features in this invention, the pads 54 may be set at any desired intermediate position. Furthermore, by this mechanism the desired diameter may be set and locked in place so that it will remain constant regardless of variations in drill string weight, pump pressure or flow rate which may be chosen for optimum drilling conditions.

The operation of the illustrated embodiment may be understood by the following example.

The spline bars 16 allow the male spline 4 to move vertically relative to the female spline and the main body of the stabilizer sub. The downward movement is limited by the male spline shoulder 6 which seats on the seal cap 8 and the upward limits of the movement of the male spline is governed by the upper stop ring 24 which encounters the top of the bore in which it is located. If the male spline is moved upward, the extension 18 will rise out of and above the slip fingers 40 and the slip fingers are then free to flex inwardly so that they are no longer rigidly locked in vertical relationship to the slip seal ring 32.

In this position, the slip fingers and the pad mandrel 44 to which they are connected are free to move vertically.

If no mud pressure is applied, the spring 64 will urge the mandrel into its uppermost position as illustrated in FIG. 1, in which the top of the mandrel is butting against the lower end of the slip seal ring 32. The pads 54 are then retracted.

If increased pressure is applied by the mud pump, this pressure will be communicated down the bore of the drill string to the bottom of the male spline extension 18 and through the gaps between the split fingers to the top of the pad mandrel where the pressure will be applied across an area equivalent to the difference between the diameter of the main body and the inner diameter of the pad mandrel. This pressure will tend to force the pad mandrel downward against the resistance of the spring 64 and the distance of that vertical movement will depend on the degree of mud pump pressure which is applied against that spring. As the pad mandrel moves downwardly, the inclined surfaces 50 will bear against the mating surfaces 52 of the pads 54 and force them in a radially outward direction against the resistance of the pad springs 56 and the degree of vertical movement of the pad mandrel will determine the degree of outward movement of the pads and therefore determine the chosen setting between the minimum and maximum diameter. By suitable testing and calibration, it can be determined what degree of mud pump pressure is required to compress the spring 64 in order to achieve various degrees of adjustment of the pads and thus the overall diameter of the stabilizer sub.

Once the adjusted diameter is achieved, the position may be locked by lowering the drill string so that the male spline extension 18 moves downwardly into the position illustrated in FIG. 1(*b*) where it forces the slip fingers outwardly to engage the teeth of the slip ring 32 thus locking the fingers and therefore the pad mandrel in vertical relationship to the main body. In this way the radial setting of the pads 54 will remain fixed.

The various seals separate the drilling mud flow from the parts of the mechanism which are filled with hydraulic fluid to avoid contamination and to isolate pressures needed to activate the mechanism.

The lower anular port 74 exposes the bottom of the floating piston and therefore the spring chamber and the lower end of the pad mandrel to the mud pressure of the bore hole annulus which is generally lower than the mud pressure on the inner bore of the string because of the restriction at the drill bit. Thus, an increased pump pressure will have the effect of moving the pad mandrel vertically downward when the tool is in the adjustable position.

As previously mentioned, the pads illustrated in FIG. 1(*b*) are shown in vertical alignment for ease of illustration but it may be desirable to arrange them in an inclined helical sequence so that they are distributed evenly around the circumference of the stabilizer sub.

Figure 5:
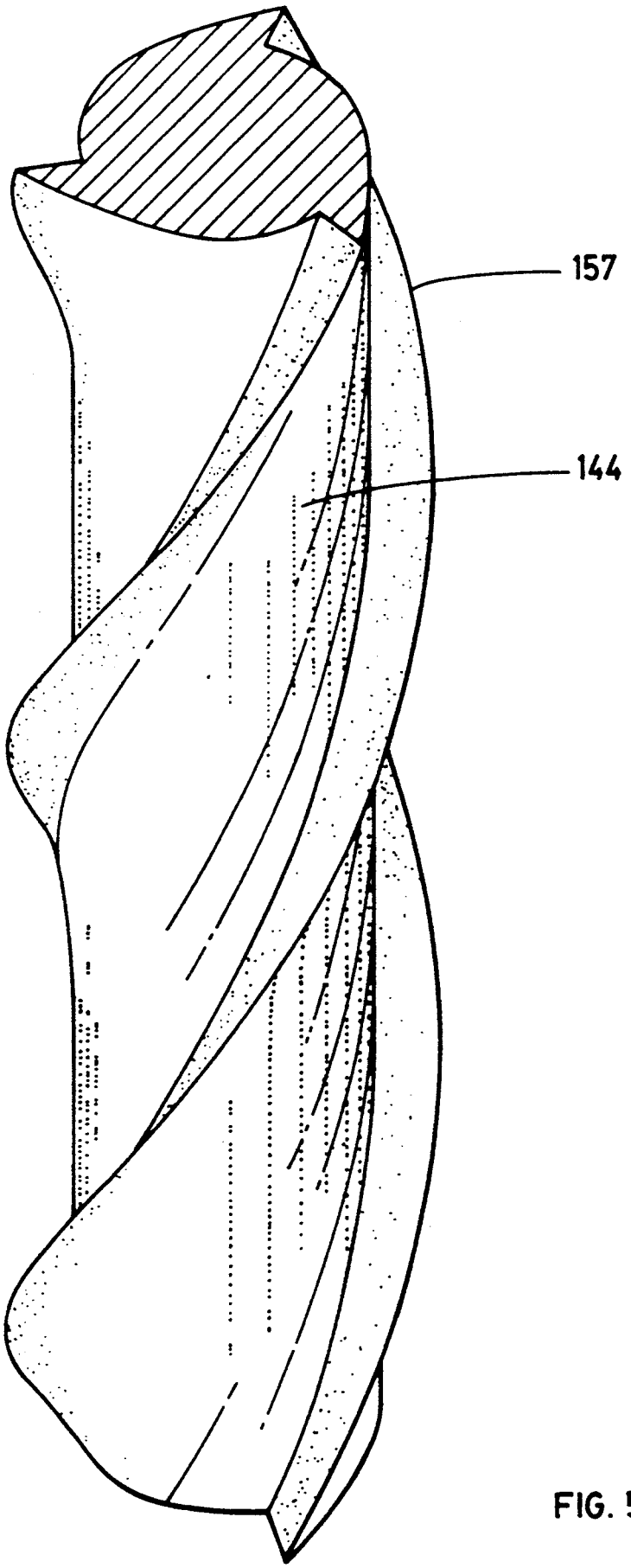
FIG. 5 is a graphic representation of a perspective view of the part showing in FIGS. 3(*a*), 3(*b*) and 3(*c*).

It is also possible to use a pad mandrel in which the inclined surface bearing against the inner end of the pads is not a tapered, truncated, cone shape about a vertical axis as illustrated in 1(*b*) but may be an inclined surface in which the radius varies in a horizontal circumferential direction as illustrated in FIG. 5.

Figure 3A:
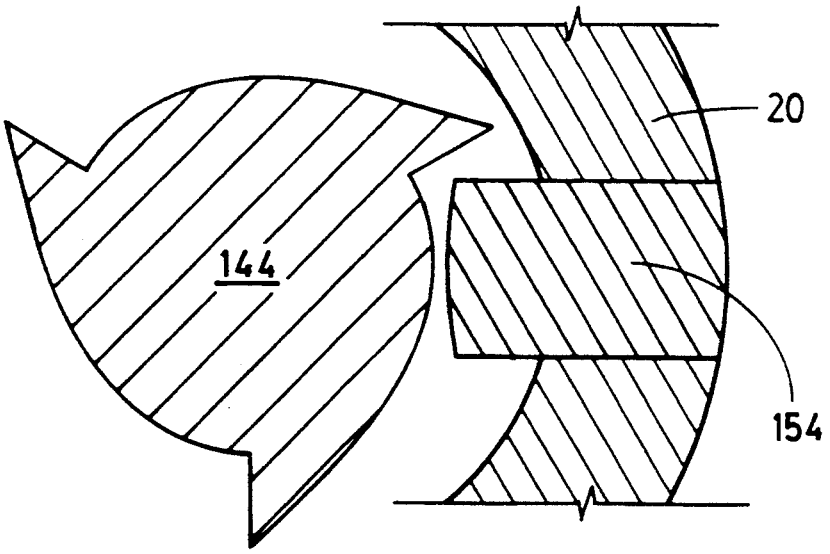
FIGS. 3(*a*), 3(*b*) and 3(*c*) are schematic illustrations of activating parts of the mechanism in three different positions.
Figure 3B:
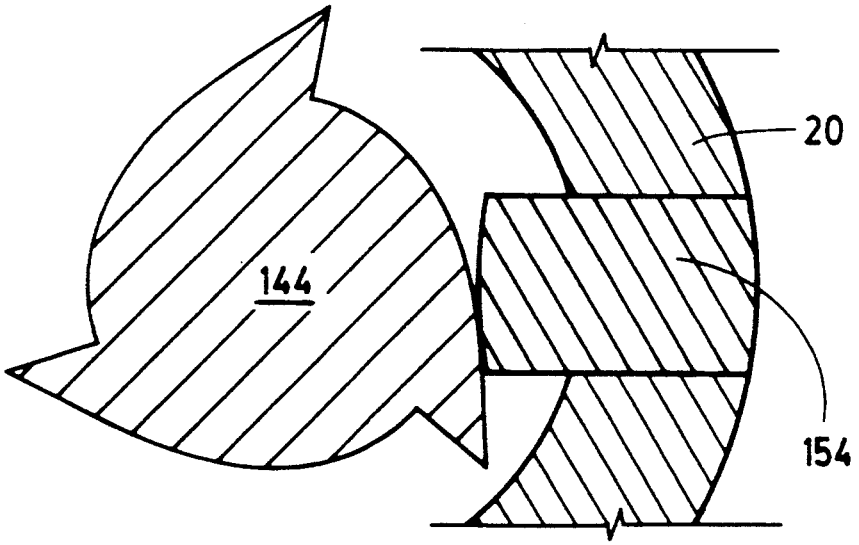
Figure 3C:
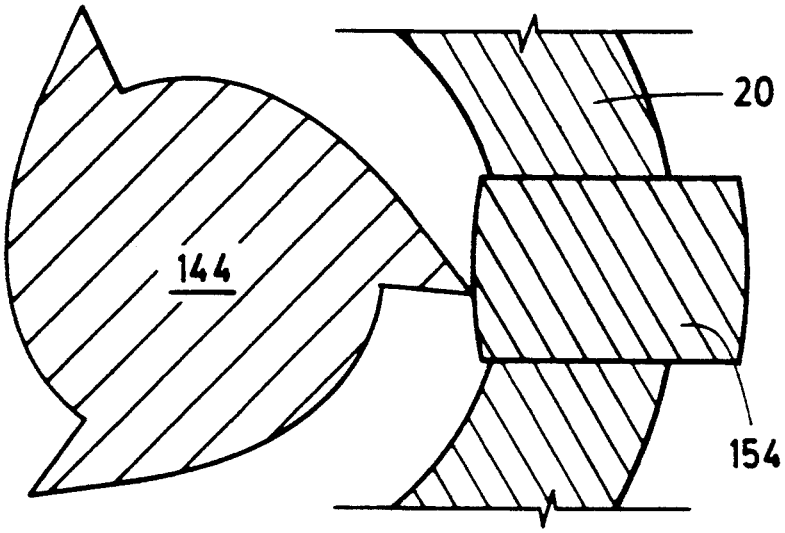

The operation of this version is illustrated in FIGS. 3(*a*), 3(*b*) and 3(*c*). On the left, the horizontal cross section of a modified pad mandrel 144 is illustrated with a pad 154 located at various positions on the mandrel.

It will be appreciated that if a mandrel of this configuration is rotated counter clockwise relative to the pad as illustrated sequentially in FIGS. 3(*a*), (3(*b*) and 3(*c*), the increasing diameter of the mandrel 144 will push the plug 154 in an outward radial direction.

If the mandrel shown in FIG. 5 has pads positioned in an inclined, helical, configuration, the cam effect of the profile can be effected by rotational movement, vertical movement, or a combination of both. Thus, as illustrated schematically to the left in FIGS. 3(*a*), 3(*b*) and 3(*c*), the edge of the profile 157 is represented by an inclined or helical line and the relative location of the plugs (also arranged in an inclined helical sequence, shown in relative proximity. As the extreme outer dimension of the mandrel represented by the line 157 moves downwardly and/or rotatingly towards the plugs 154, the increased diameter of the mandrel will cause the plugs to move radially outward to a larger diameter.

Thus, the vertical movement illustrated in FIG. 1 may be employed to effect adjustment with a mandrel with an inclined configuration shown in FIGS. 3 and 5. In this case, since the mandrel is not cylindrical, it is important to control the rotational position of the mandrel and this is done by means of a keyway 160 cut in the bottom of the mandrel and a cooperating key 162 locked in the lower main body of the sub. If the key and keyway are vertically disposed, the mandrel will move vertically but will be fixed against rotational movement. If the keyway is inclined, vertical movement of the pad mandrel will result in a combined vertical and rotational movement. Either way, the relative movement of the mandrel from a position in which the pads contact a small diameter portion to a position in which the pads contact a larger diameter portion will have the effect of increasing the radius of the stabilizer sub.

Figure 2A:
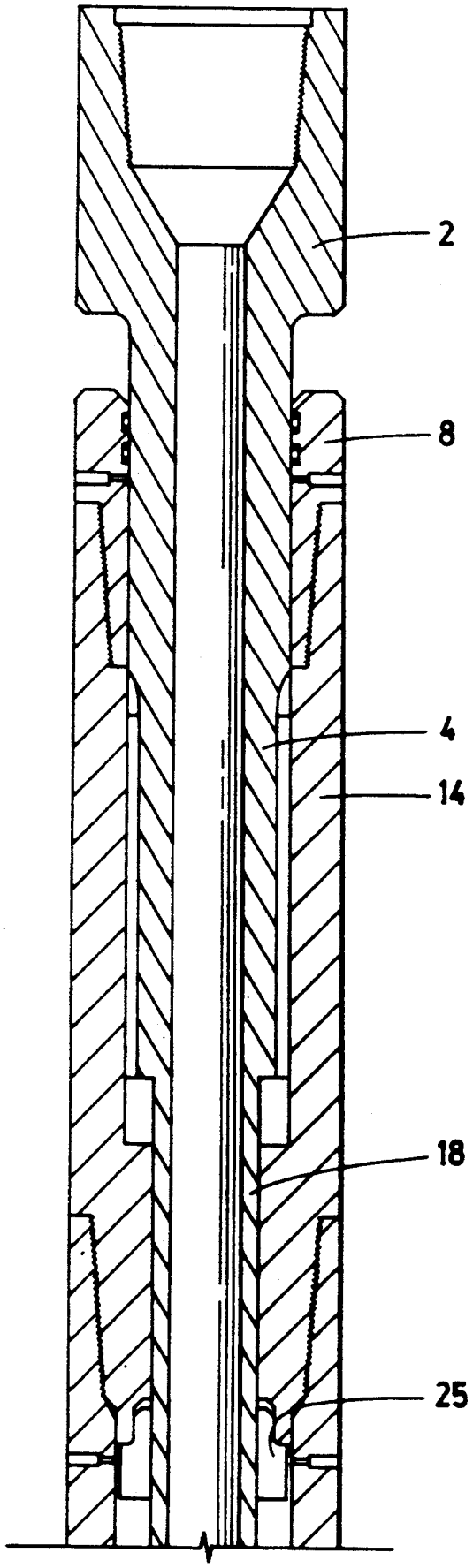
FIG. 2(*a*) and FIG. 2(*b*) are illustrations of a modified version of the mechanism shown in FIG. 1 in two different setting positions.
Figure 2B:
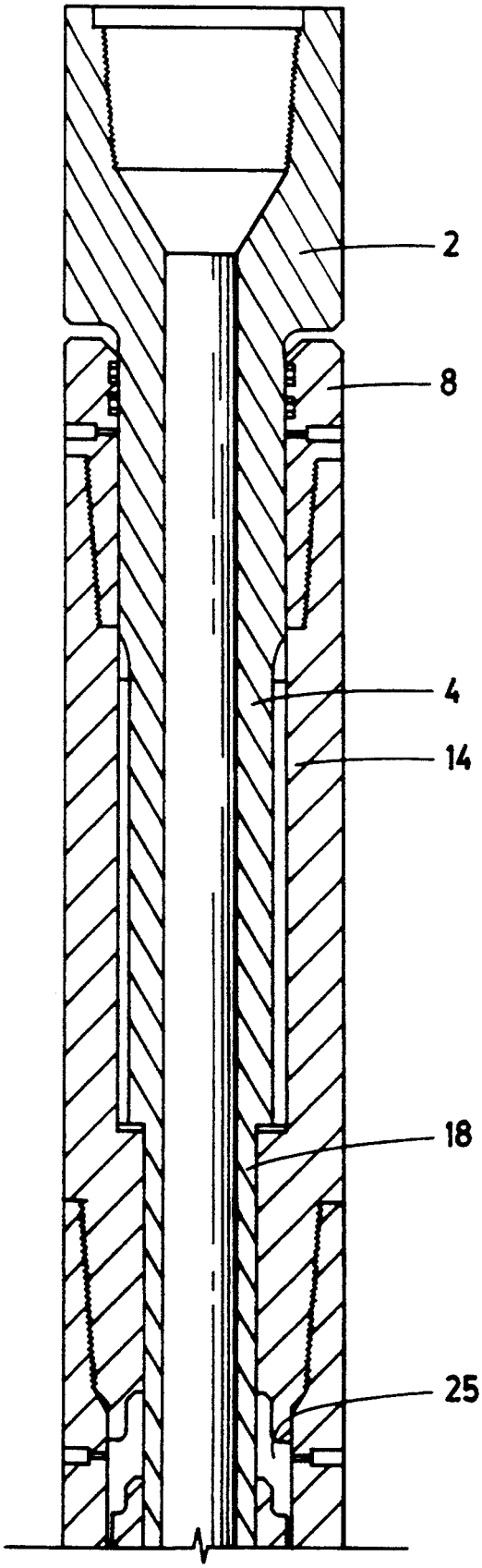

An alternative arrangement is shown in FIGS. 2(*a*) and 2(*b*) in which the male spline 4 has a stopper ring 25 threaded onto the lower extension 18 which butts against the pin end of the female spline sub 14 to limit upward movement. The downward position is illustrated in FIG. 2(*b*).

Figure 4A:
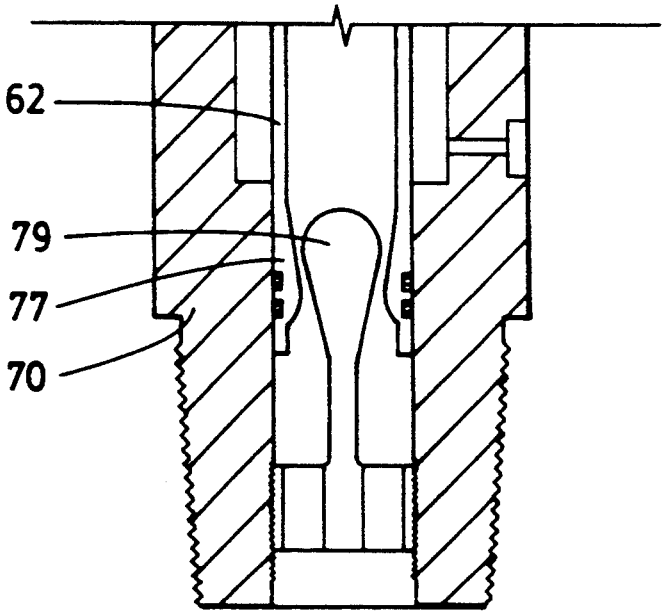
FIGS. 4(*a*) and 4(*b*) show in vertical cross section, a modified version of the mechanism in FIG. 1 in two positions respectively.
Figure 4B:
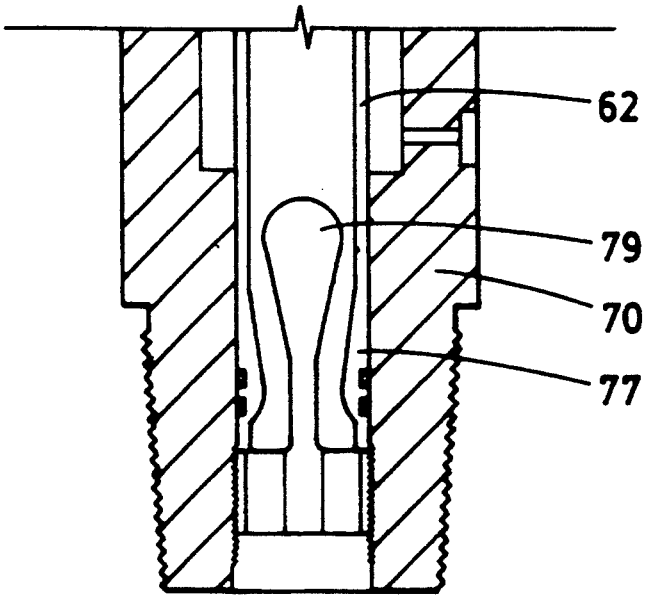

An alternative arrangement of the flow restrictor is illustrated in FIGS. 4(*a*) and 4(*b*) in which the constriction in the bore formed by a diminished ID 77 is located in the bottom of the wash pipe 62 and therefore moves up and down with the mandrel while the plug 79 is adjustably fixed by threads 81 to the bottom of the main body of the sub. Thus, in the position shown in FIG. 4(*b*) the drill string bore is relatively open to mud flow whereas in the position of FIG. 4(*a*) the flow is considerably restricted and will result in a measurable back pressure at the mud pump. This measurable back pressure can be used by the driller as an indication of the vertical location of the mandrel and therefore the diameter adjustment.

Because the arrangement of the male spline and extension telescope for vertical movement relative to and within the main body of the tool, the application of increased pump pressure will have a piston and cylinder effect and will tend to drive the male spline vertically upwards relative to the main body causing unwanted release of the slip fingers unless the tendency is overcome by the weight of the drill string. If the pump pressure is sufficiently high and acts on a surface area sufficiently large (i.e. 2,000 psi × 10 sq. in. = 20,000 lbs.), the upward pressure may require an excessive amount of weight on the drill string. To overcome this, the embodiment illustrated in FIG. 6 provides for a port 232 in the extension which will equalize the pressure in between the interior and the exterior of the extension, which pressure will be blocked in the upward direction by the fixed seal ring 236 held by the set screws 238 but will have a downward effect on the seal ring 234 and, therefore, provide a balanced downward force on the extension 18 and therefore the male spline. A second annular port 230 releaves the pressure beneath the fixed extension ring 234.

Mechanisms such as the embodiments illustrated may be calibrated so that known operating criteria such as mud pump pressure or flow rate will provide the desired vertical movement (or vertical and rotational movement) of the mandrel sufficient to achieve various degrees of expansion or activation of the pads so as to effect specific desired diameters.

Similarly, the flow restrictor and bullet or plug may be adjusted and calibrated so that the operator can identify the precise location of the mandrel by virtue of the back pressure effected by the flow restrictor.

Thus, by means of the present invention, a down hole adjustable stabilizer may be activated by lifting the drill string sufficient to release the slip finger, activating the mud pump to effect the desired degree of vertical movement of the mandrel and therefore the desired degree of increased diameter in the stabilizer pads and then this setting may be locked by returning the male spline extension into engagement with the fingers to lock them in position and maintain the relative vertical adjustment of the mandrel. This adjustment setting will then be maintained during drilling operations regardless of the weight on the bit, the flow rate of the circulating mud or the pump pressure applied. Similarly, the pads may be deactivated or readjusted repeatedly as desired.

It will, of course, be realized that numerous modifications and variations of the illustrated embodiment may be employed without departing from the inventive concept herein.

I claim:

1. A down hole drilling tool activating mechanism comprising;

a drill sub connectable between adjacent lengths of drill pipe having a main body;

tool elements mounted in said body to be activated and deactivated;

a mandrel located within said main body capable of vertical movement relative to said main body and having cam surfaces bearing against said tool elements to activate and deactivate same upon vertical movement of the mandrel;

a series of flexible fingers extending from one end of said mandrel and vertically fixed thereto, said fingers having engaging teeth thereon;

teeth engaging means mounted to said main body and vertically fixed relative thereto;

a male spline member rotatably locked to said main body and capable of vertical movement relative to said main body;

a portion of said male spline member being moveable vertically within said main body between a locking position in which said male spline member engages said flexible fingers forcing them to engage said tooth engaging member and an unlocked position in which said male spline member is removed from said flexible fingers to allow them to disengage said teeth engaging member;

bias means urging said mandrel in one vertical direction;

seal means on said mandrel located such that mud pump pressure exerted through the bore of said drill string will act on an end of said mandrel in a direction opposite to said bias means;

means to equalize pressure between the interior and exterior of said male spline member.

2. A mechanism as claimed in claim 1 in which said tool is a stabilizer and said tool elements are radially adjustable pads.

3. A mechanism as claimed in claim 2 in which said pads have an inwardly inclined surface and said mandrel has truncated conical shaped elements bearing against said inclined surfaces.

4. A mechanism as claimed in claim 2 in which said mandrel comprises at least one surface adapted to bear against the inner surface of said pads, said mandrel surface being shaped to provide an increasing radial dimension in a given circumferential direction so that rotational movement will activate or deactivate said pads.

5. A mechanism as claimed in claim 4 in which said mandrel has a helical configuration about the longitudinal axis of said mandrel.

6. A mechanism as claimed in claim 5 in which the rotation of said mandrel is controlled by a key engaging keyway controlling the relative rotational motion between said mandrel and said main body.

7. A mechanism as claimed in claims 1, 2, 3, 4, 5 or 6 in which a flow restrictor is mounted in said drill sub;

said flow restrictor comprising a restrictor sleeve mounted for movement with one of said mandrel and said main body and a bullet is mounted for movement with the other of said mandrel and said main body such that the back pressure resulting from restricted flow is variable according to the relative vertical position of said mandrel relative to said main body.

8. A mechanism as claimed in claim 1, 2, 3, 4, 5, or 6 in which said means to equalize pressure include a port communicating between the interior and the exterior of said male spline member;

a fixed seal ring providing a seal between the exterior of said male spline member and the interior of said main body above said port and fixed against vertical movement relative to said main body;

a seal ring mounted on the exterior surface of said male spline member and moveable therewith relative to said main body and providing a seal against the interior surface of said main body.

* * * * *